US006652387B2

(12) United States Patent
Liberatore

(10) Patent No.: US 6,652,387 B2
(45) **Date of Patent: *Nov. 25, 2003**

(54) WEIGHT HOLDING DEVICE ATTACHABLE TO GOLF CLUB HEAD

(76) Inventor: Raymond A. Liberatore, 12143 Punkin Hollow Rd., Bentonville, AR (US) 72713

( * ) Notice: Subject to any disclaimer, the term of this patent is extended or adjusted under 35 U.S.C. 154(b) by 0 days.

This patent is subject to a terminal disclaimer.

(21) Appl. No.: 09/988,862

(22) Filed: Nov. 21, 2001

(65) Prior Publication Data

US 2002/0123389 A1 Sep. 5, 2002

Related U.S. Application Data

(63) Continuation-in-part of application No. 09/799,913, filed on Mar. 5, 2001, now Pat. No. 6,443,851.

(51) Int. Cl.[7] ..... A63B 69/36
(52) U.S. Cl. ..... 473/256; 150/160; 273/DIG. 30
(58) Field of Search ..... 473/256, 231, 473/238, 242, 437, 524, 553; 273/DIG. 30; 150/16; 206/315.4

(56) References Cited

U.S. PATENT DOCUMENTS

| | | | |
|---|---|---|---|
| 1,674,136 A | | 6/1928 | Shidler |
| D169,880 S | | 6/1953 | Williams |
| 2,676,803 A | | 4/1954 | Damaske |
| 2,737,394 A | | 3/1956 | Abel |
| 3,145,749 A | | 8/1964 | Rosenow |
| 3,231,281 A | | 1/1966 | Wallo |
| 3,398,961 A | | 8/1968 | Higdon |
| 3,593,769 A | | 7/1971 | Spears |
| 4,213,614 A | | 7/1980 | Philippi |
| 4,602,788 A | | 7/1986 | Wendt |
| 4,842,280 A | | 6/1989 | Hilton |
| 5,000,238 A | | 3/1991 | Zeller |
| 5,230,512 A | | 7/1993 | Tuttershell |
| 5,294,127 A | | 3/1994 | Keelan |
| 5,403,009 A | | 4/1995 | Gleason, Jr. |
| 5,527,038 A | | 6/1996 | Mabie |
| 5,609,531 A | | 3/1997 | Gates |
| 5,615,720 A | | 4/1997 | O'Sullivan |
| 5,776,006 A | | 7/1998 | Gruber |
| 6,015,354 A | | 1/2000 | Ahn et al. |
| 6,065,516 A | | 5/2000 | Chang |
| 6,083,116 A | | 7/2000 | Loredo |
| 6,102,810 A | | 8/2000 | Boland |
| 6,120,385 A | | 9/2000 | Nemeckay |
| 6,126,556 A | | 10/2000 | Hsieh |
| 6,443,851 B1 | * | 9/2002 | Liberatore |
| 6,461,249 B2 | * | 10/2002 | Libertore |

OTHER PUBLICATIONS

SwingSock Golf, Inc. v. Wizard Golf, Inc. Case No.CV–2003–5032 In The United States District Court For The Western District of Arkansas Fayetteville Division.

* cited by examiner

*Primary Examiner*—Sebastiano Passaniti
(74) *Attorney, Agent, or Firm*—William W. Haefliger

(57) ABSTRACT

A weighting device for use on a golf club head as during swinging of the club, comprising in combination, a receptacle having an opening via which the club head is received into the receptacle, a retainer carried on the receptacle to be fastened in a position for retaining the receptacle in fitting relation to the club head, and weighting structure carried by the receptacle to add substantial weight to the club head weight, for use as in club head swinging. Various other forms of the receptacle and retainer are provided.

43 Claims, 15 Drawing Sheets

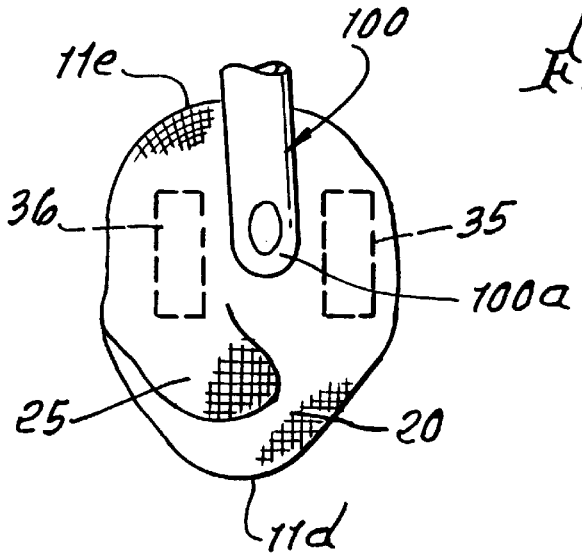
FIG. 3.
FIG. 4.
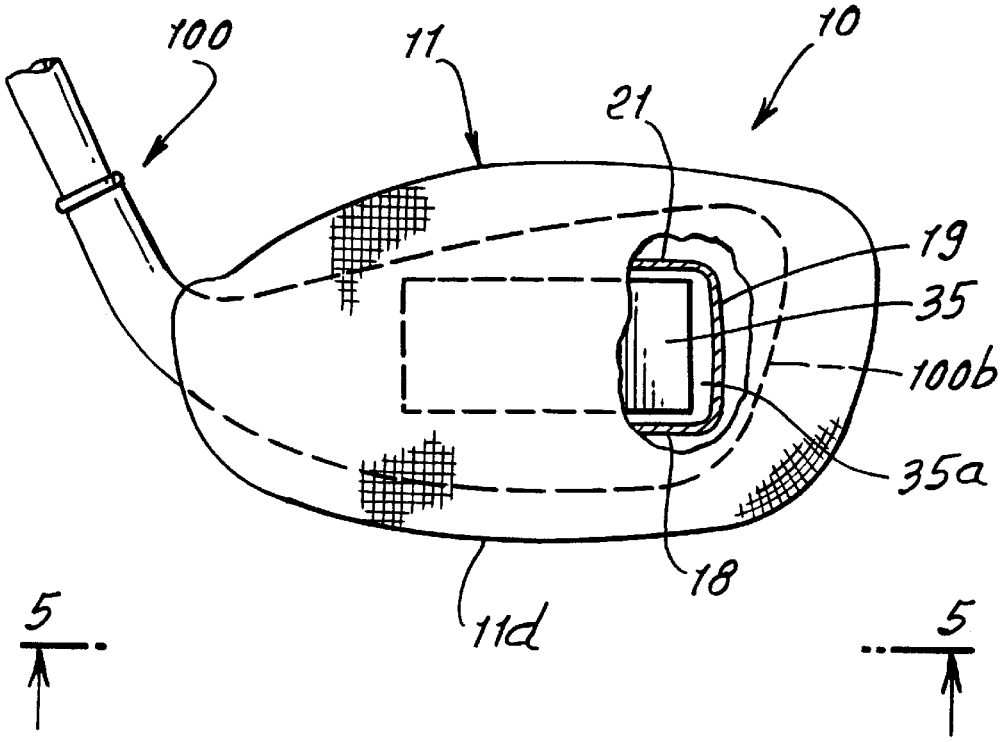

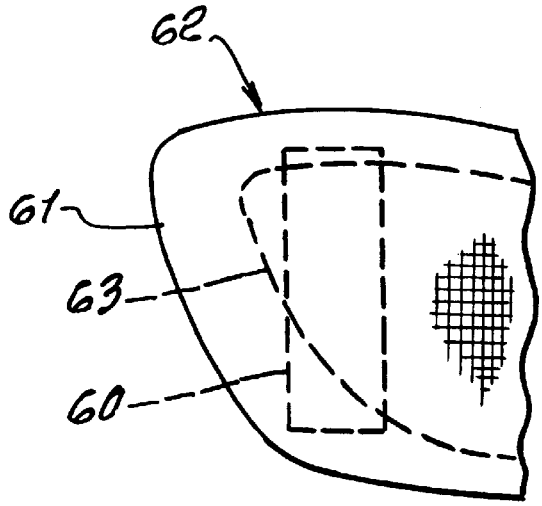
FIG. 7.
FIG. 8.
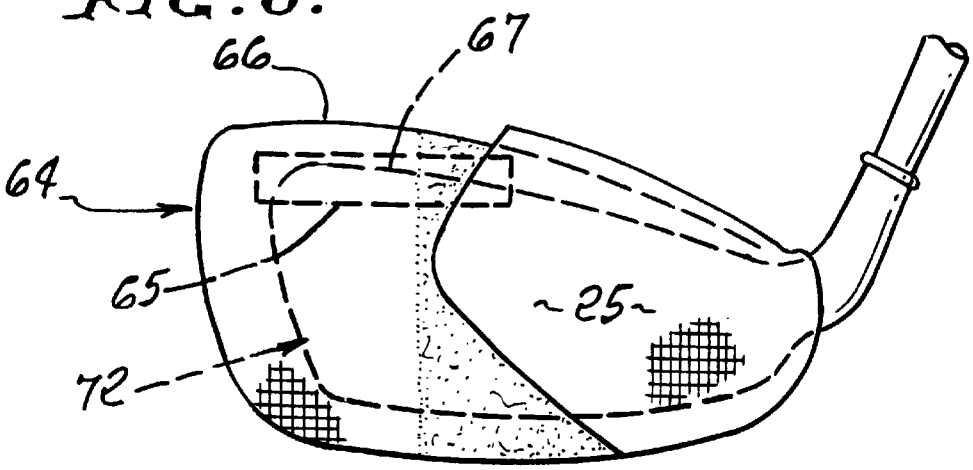
FIG. 9.
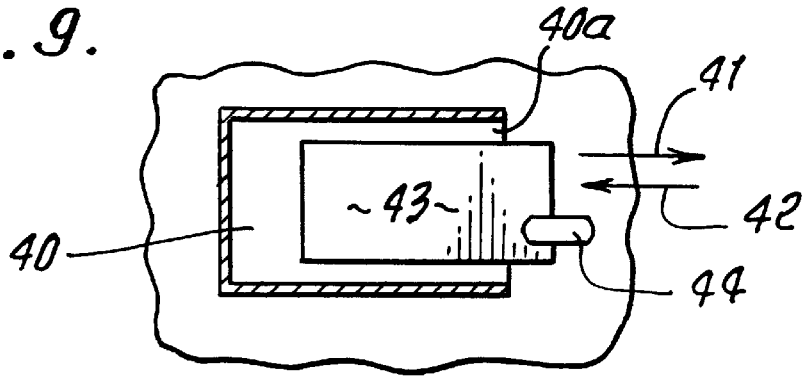

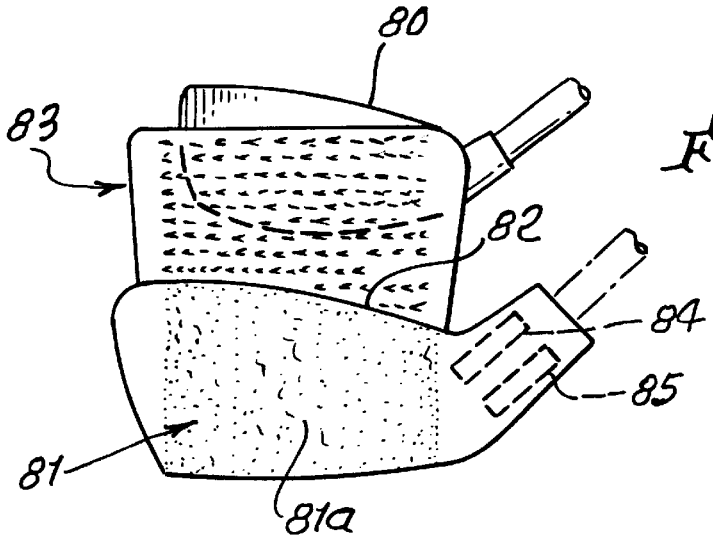
FIG. 10.
FIG. 11.
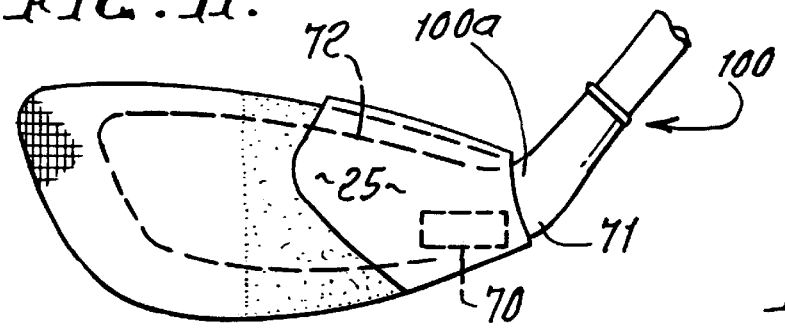
FIG. 12.
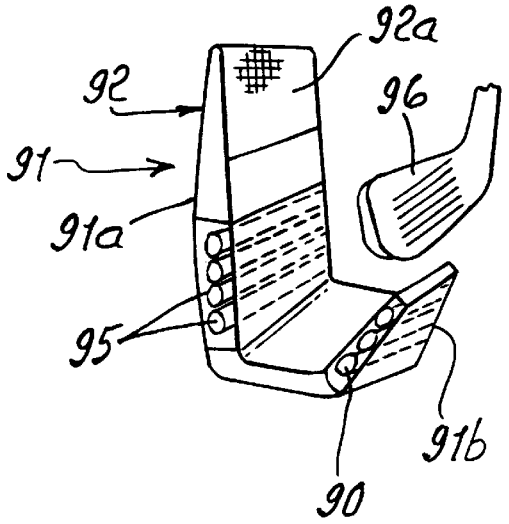
FIG. 13.
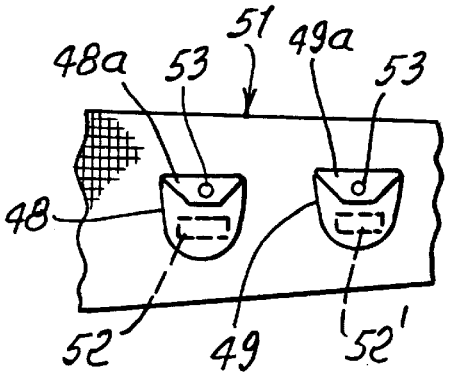

FIG. 19.
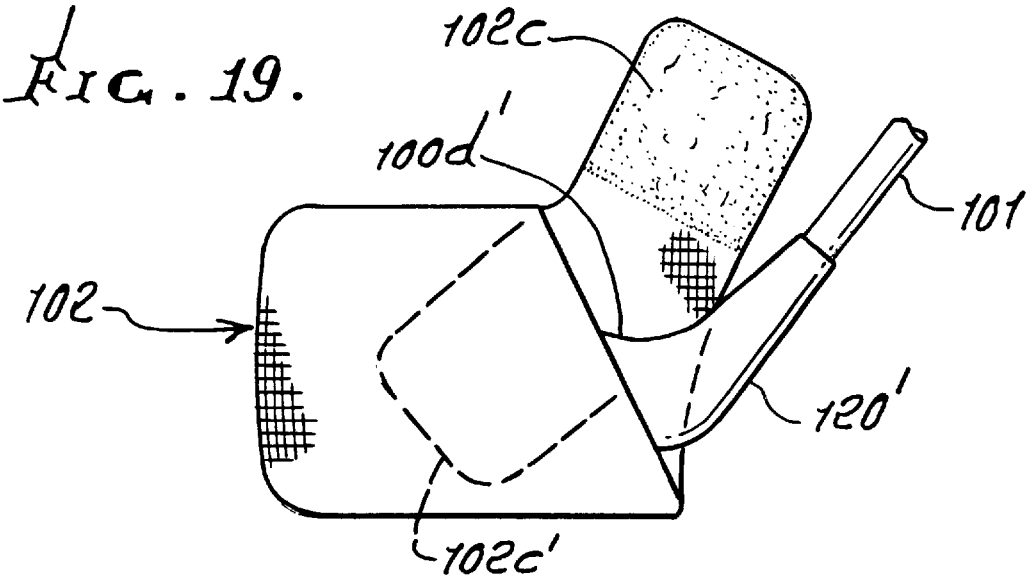
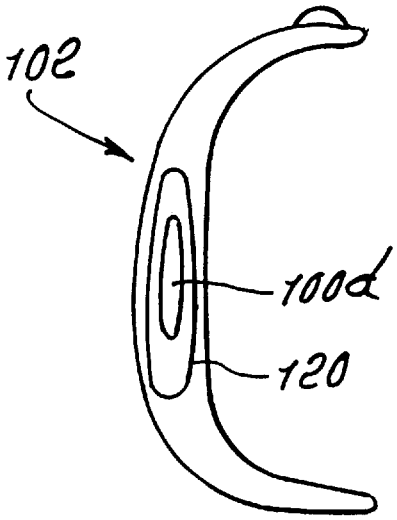
FIG. 20.
FIG. 21.
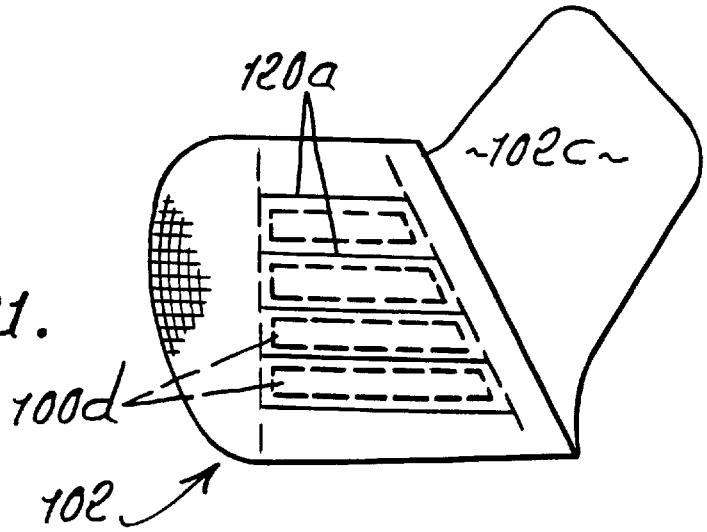

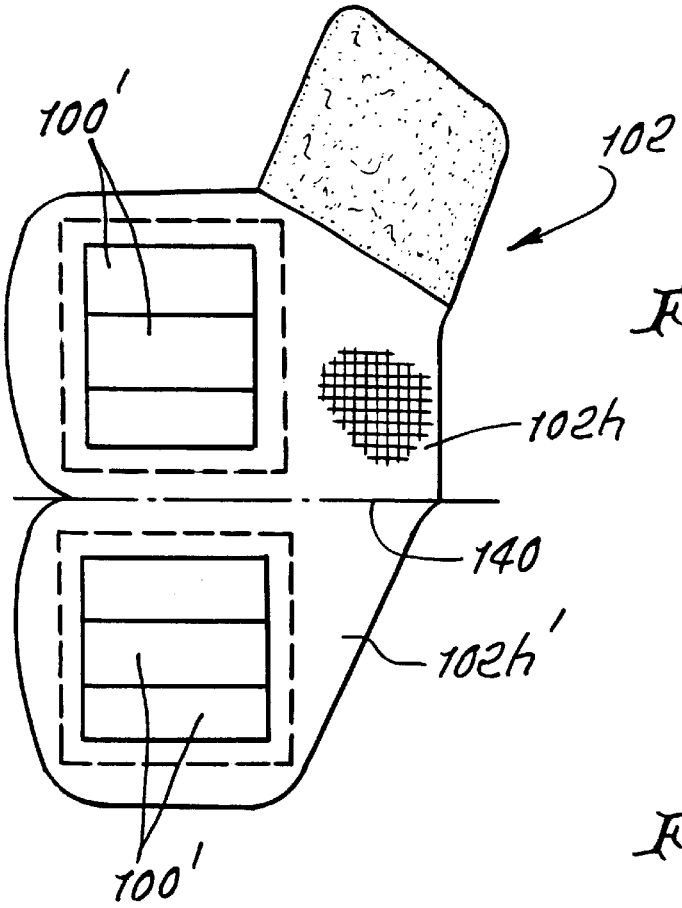
FIG. 28.
FIG. 30.
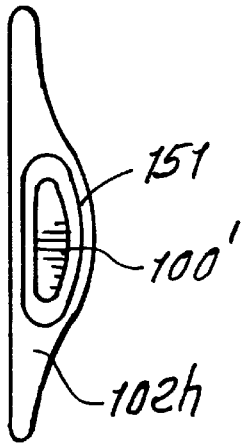
FIG. 29.
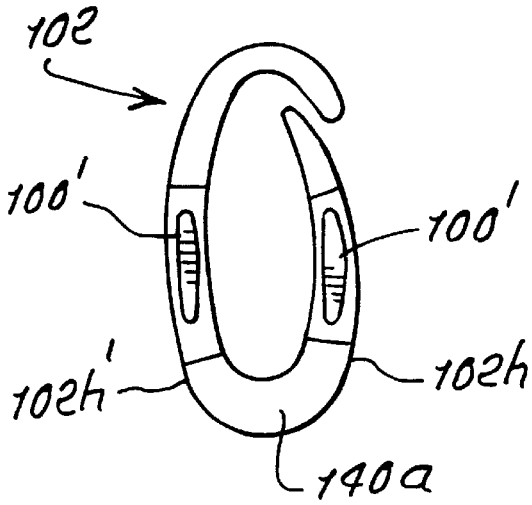

WEIGHT HOLDING DEVICE ATTACHABLE TO GOLF CLUB HEAD

This application is a continuation-in-part of Ser. No. 09/799,913, filed Mar. 5, 2001 now U.S. Pat. No. 6,443,851.

BACKGROUND OF THE INVENTION

This invention relates generally to swinging of golf clubs, as for example irons; and more particularly concerns removably adding weight to a golf club, such as at a selectable location or locations proximate the head.

When golfers warm-up, or train, they commonly use two clubs, such as irons, and swing them in unison a few times to loosen muscles. Holding and swinging two clubs is awkward, uncomfortable, and does not achieve the right feel, needed as by gripping and swinging only one club; but one club does not achieve additional weight as can be provided by two clubs. There is need to overcome this dilemma, in a simple, effective and efficient manner, as is now provided by the present invention.

SUMMARY OF THE INVENTION

It is a major object of the invention to provide a simple and effective weighting device or devices meeting the above need, for golf clubs. Basically, the device comprises:

a) a receptacle having an opening via which the club head is received into the receptacle, b) a retainer carried on the receptacle to be fastened in a position for retaining the receptacle in generally fitting relation to the club head, c) and weighting structure carried by the receptacle to add substantial weight to the club head, for use as in club swinging, d) said receptacle having a front portion, a bottom portion, a toe portion, a heel portion, a back portion, and a top portion; and said weighting structure located proximate at least one of said portions.

The invention is applicable, for example, to devices which comprises:

x) a receptacle having an opening via which the club head is received into the receptacle, y) a retainer carried on the receptacle to be fastened in a position for retaining the receptacle in fitting relation to the club head, z) and weighting structure carried by the receptacle to add substantial weight to the head weight, for use as in club swinging.

As will be seen, the retainer preferably comprises a flap or strap carried to extend at least part way about the receptacle, when closed on a golf club head, and hook and pile fastening material such as VELCRO may be provided to adhere the flap or strap in fastening position.

Another object includes provision of a receptacle having at least two of the following:

i) a wall portion to extend adjacent the front face of the club head ii) a wall portion to extend adjacent the rear side of the club head iii) a wall portion to extend adjacent the bottom surface of the club head iv) a wall portion to extend adjacent the toe of the club head v) a wall portion to extend adjacent the heel of the club head vi) a wall portion to extend adjacent the top edge of the club head; and the weighting structure is located at or proximate at least one of such wall portions.

Further, the weighting structure is typically located proximate one of the following:

vii) at least one of the wall portions, viii)at least two of the wall portions, ix) at least three of the wall portions, x) at least four of said wall portions.

In addition, the weighting structure typically includes metallic material, solid or flowable; it is typically concealed by the receptacle; and it may include separate localized metallic portions. It may be sewn or otherwise held in a pocket or pockets provided by the receptacle, and at opposite sides of a club head retained in the receptacle.

Yet another object includes location of the weighting material in a pocket provided by the receptacle, the pocket sized to enable adjustment of the position of the material, relative to the pocket; and in this regard the pocket or pockets may enable selective use of the material in one or more pockets, for adjustable weighting, as to positioning, or as to selected weighting; or both. The receptacle may be sized to fit different or all sizes of heads.

A further object is to provide a receptacle as for reception of any golf club iron head, or wedge head, or other head; and for use of the receptacle on a head as a swing trainer, or to cure a slice or hook; or to help "release" of the club during warm-up; or to increase golfer muscle strengths or flexibility and/or to improve tempo, and/or swing speed, and/or wrist action.

Additional objects include:

1) Structure to removably carry weighting in close association to a golf club head;

2) Structure as in 1) above, which is connectible to a golf club bag;

3) Structure as in 2) above, including one of the following:

a) a flap foldable for attachment to a loop on a golf bag;

b) a fastener, having parts on the flap and on the bag or handle;

4) Structure as in 1) above wherein the flap is folded over a golf club head near the hosel, but to leave the club hosel exposed; 5) Structure as in 1) above, including a sealed or sealable enclosure or enclosures for at least one weight;

6) Structure as in 5) above including multiple of such weight enclosures located in side-by-side sequence, allowing weight relative close fitting movement when retained adjacent at a golf club head.

7) Structure as in 1) above including a club head receptacle, which is weighted, and which has a moisture proof wall or walls;

8) Structure as in 3) above in which the moisture-proof wall or walls substantially enclose a golf club head;

9) Structure as in 1) above which defines a receptacle having an expansible toe portion, to receive and fit club heads of differing sizes;

10) Structure as in 1) above including a flap that has a length to wrap over and conform to golf club heads of differing sizes including irons, putters, etc.;

11) Structure as in 1) above including a club head receptacle having an upper entrance or opening to receive the head, the receptacle having an upper flap portion that folds over the opening, with reinforcement material on an upper part of the receptacle or flap allowing unreinforced portions of the receptacle or flap to be highly flexible to conform to club head curvature;

12) The structure of 11) above wherein the reinforcement material comprises binding;

13) The structure of 1) above defining an opening to receive entrance of a golf club head into a receptacle having an upper reinforced fold proximate the club hosel;

14) The structure of 1) above that includes two like flaps that fold upwardly at front and rear sides of a club head, the metallic weighting carried at inner sides of the two flaps;

15) The structure as in 14) above in which the flaps are joined at a seamless location proximate the bottom of the club head, and are joined with reinforcement proximate the top of the club head.

16) The structure as in 15) above in which the weighting includes multiple weights encapsulated in pockets at the inner sides of said flaps.

17) The structure as in 1) above wherein such structure extends at opposite sides of a club head, and there being a first indicator color on said structure at one side of the head, and a second indicator color on said structure at the opposite side of the head.

18) The structure as in 1) above that defines a wrap to wrap closely around a club head, and a retainer to hold the wrap closed about the head.

19) The structure as in 18) above wherein the retainer includes VELCRO material;

20) The structure as in 1) above that includes a sheath that extends onto the club shaft, and the weighting is carried on said sheath. The sheath may be wrap connected to the shaft.

21) The structure as in 20) above wherein a sheath lower portion encompasses the club head, and a part of the weighting is on the sheath lower portion.

These and other objects and advantages of the invention, as well as the details of illustrative embodiments, will be more fully understood from the following specification and drawings, in which:

DRAWING DESCRIPTION

FIG. 3 is a heel end elevation taken on lines 3—3 of FIG. 1;

FIG. 4 is a rear side elevation taken on lines 4—4 of FIG. 2;

FIG. 7 is a fragmentary elevation showing a weight structure carried by a club head receptacle, near the toe end of the receptacle and club head;

FIG. 8 is a fragmentary elevation showing a weight structure carried by a club head receptacle, near the top of the receptacle and club head;

FIG. 9 is a side elevation showing removability of a weight structure, from a club head and/or adjustability of the weight structure;

FIG. 10 is a side elevation showing weight structures carried by a club head receptacle, adjacent the head hosel;

FIG. 11 is a side elevation showing a weight structure carried by a club head receptacle adjacent the heel of the receptacle and club head;

FIG. 12 is a side elevation showing cooperating weight structure on a carrier to be attached to a golf club head as by folding straps;

FIGS. 13–15 show modifications;

Figure 18A:
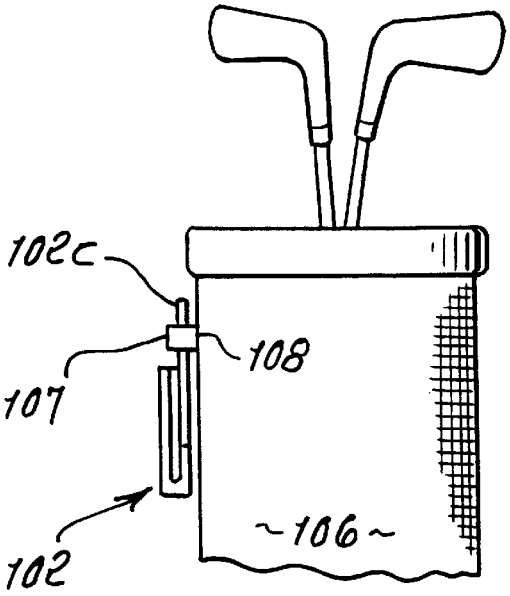
Figure 18B:
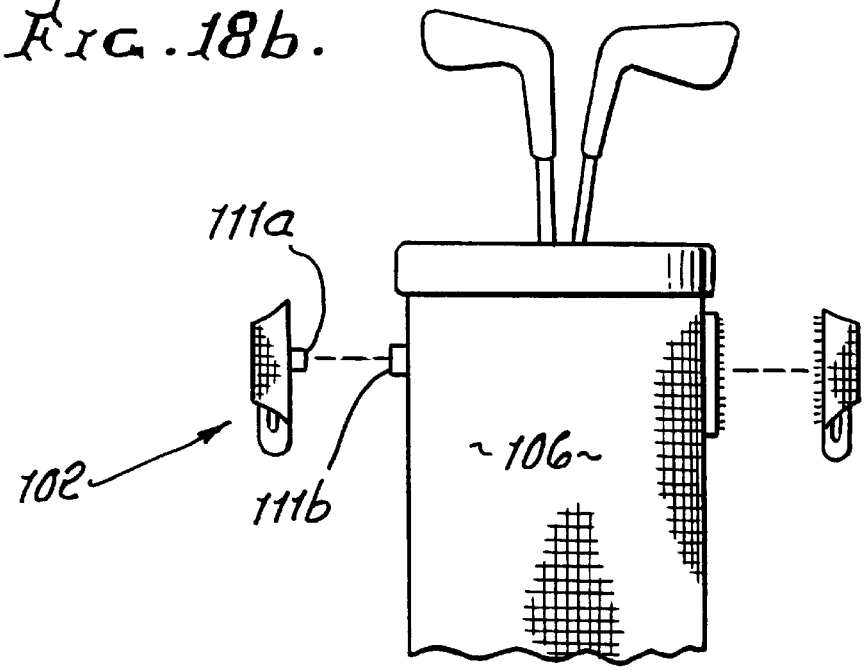
Figure 18C:
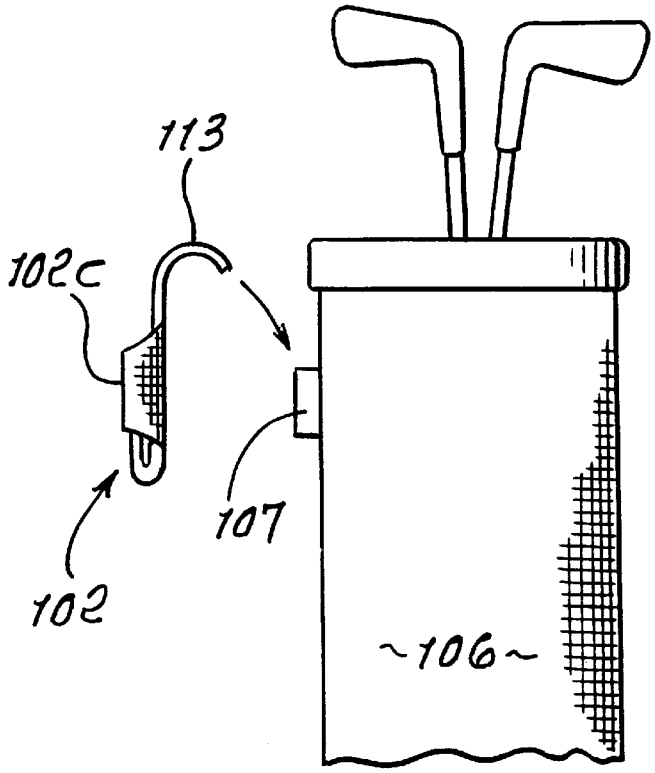
Figure 22:
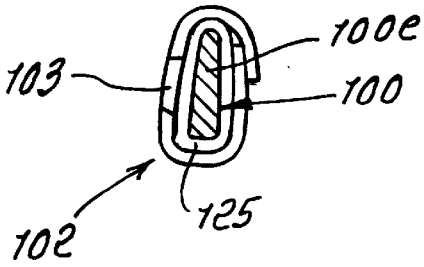
Figure 22A:
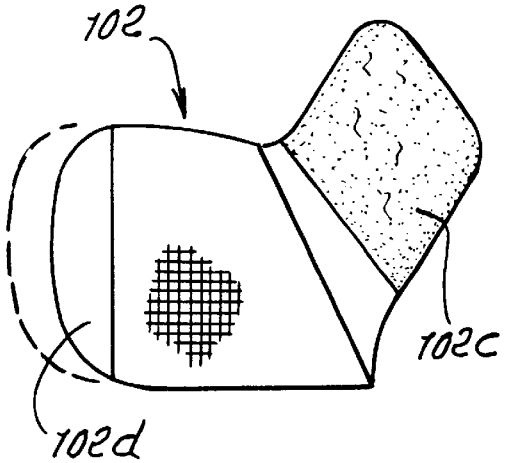
Figure 23:
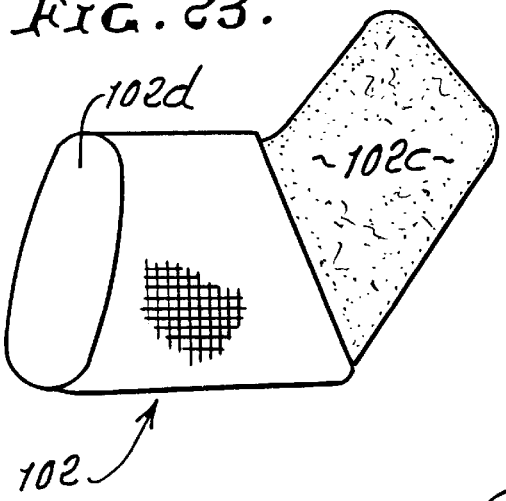
Figure 24:
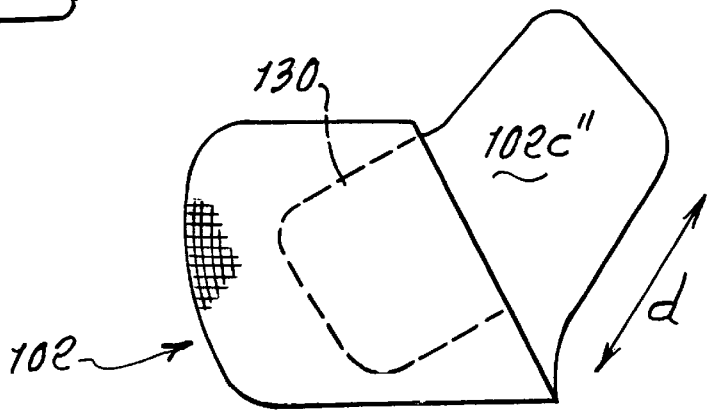
Figure 25:
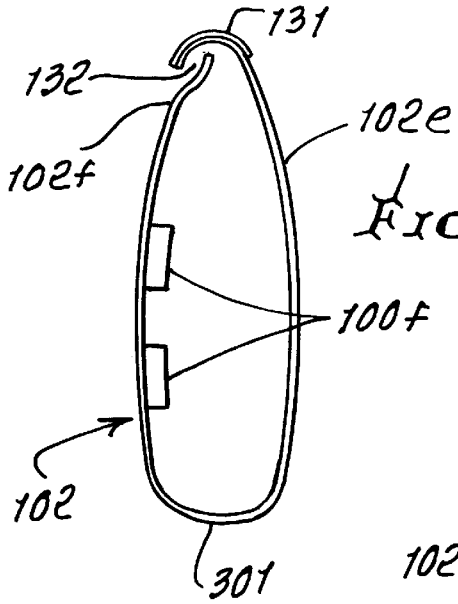
Figure 26:
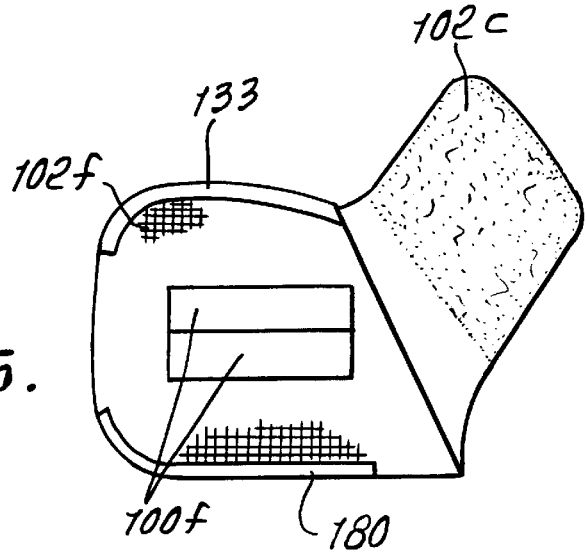
Figure 27:
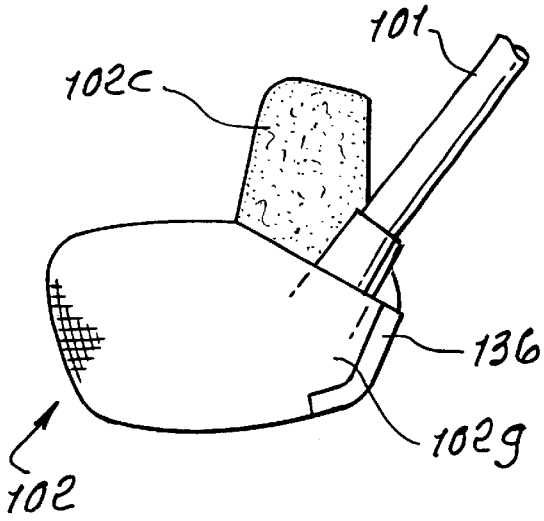
Figure 31:
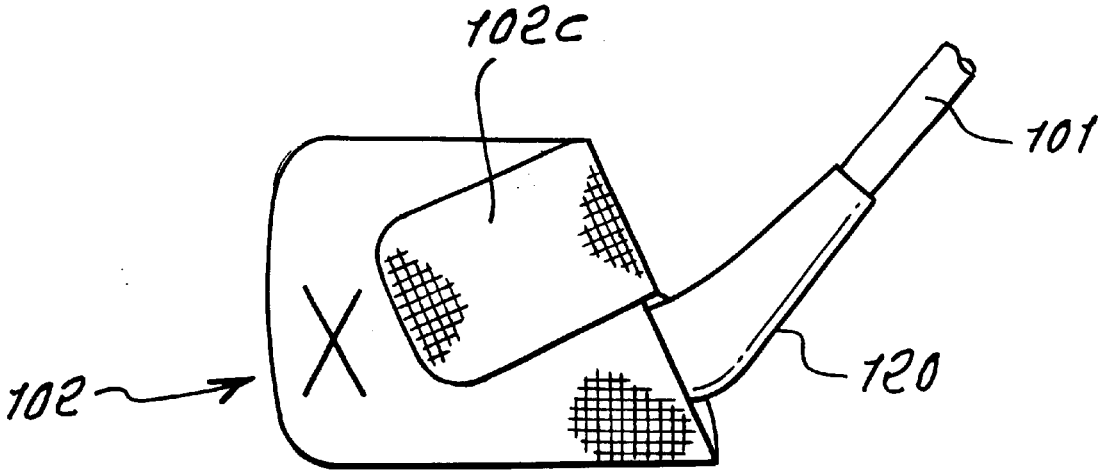
Figure 32:
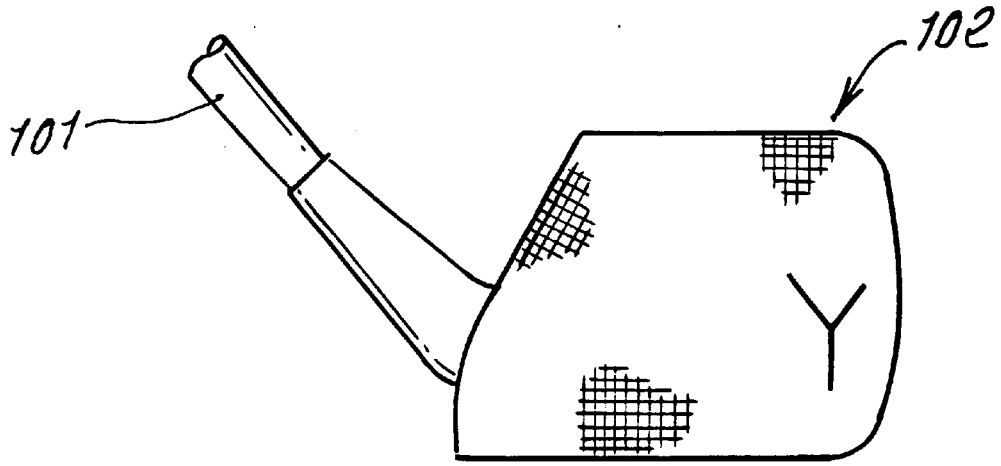
Figure 33:
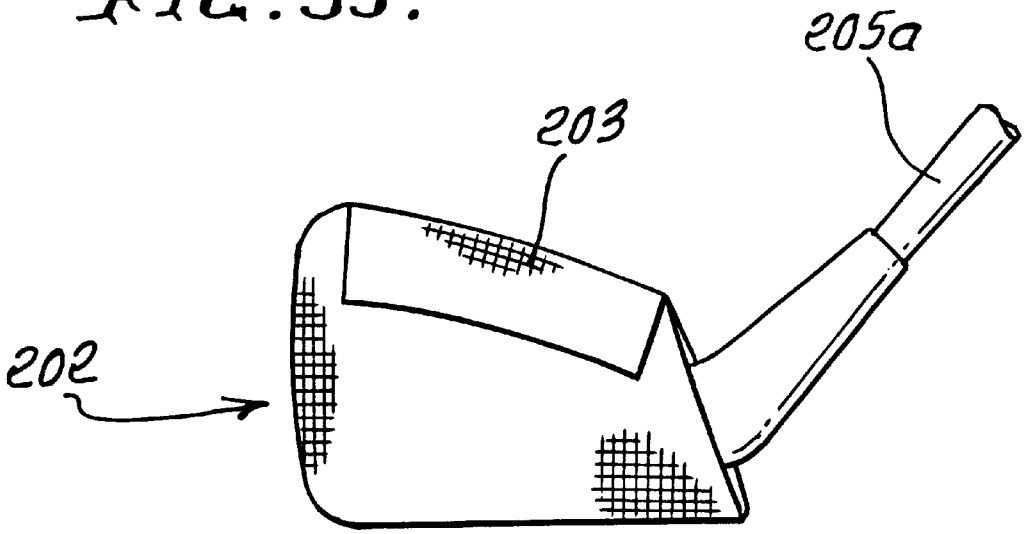
Figure 34:
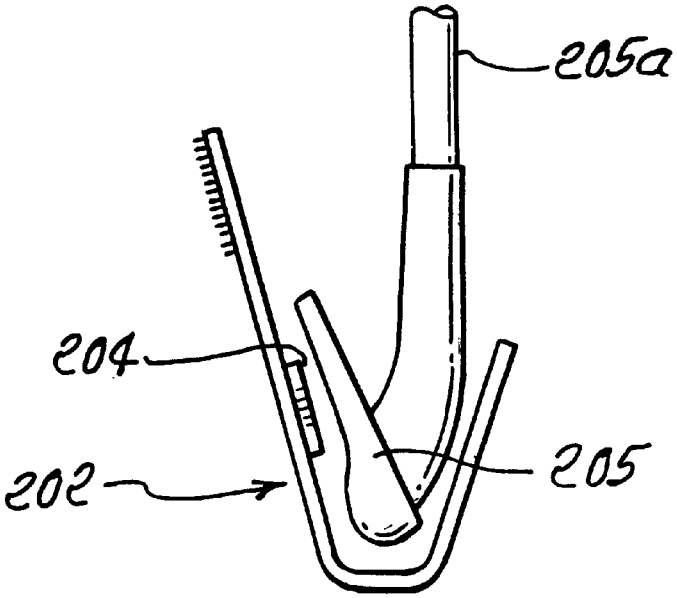
Figure 36:
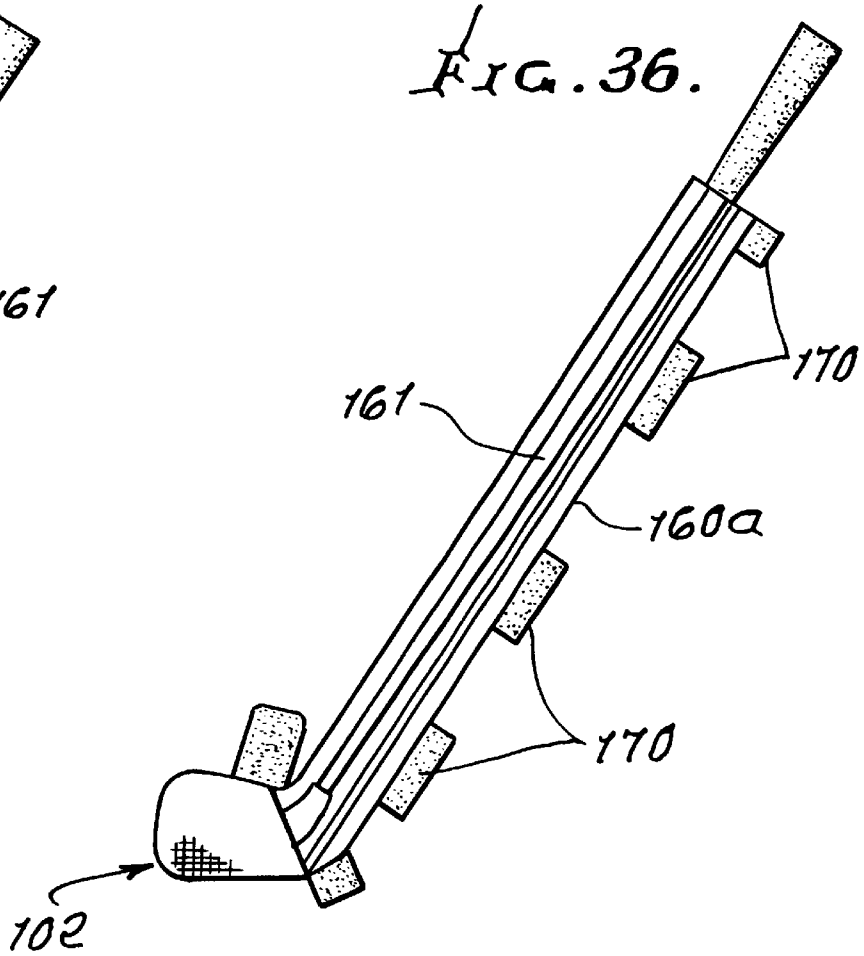
Figure 35:
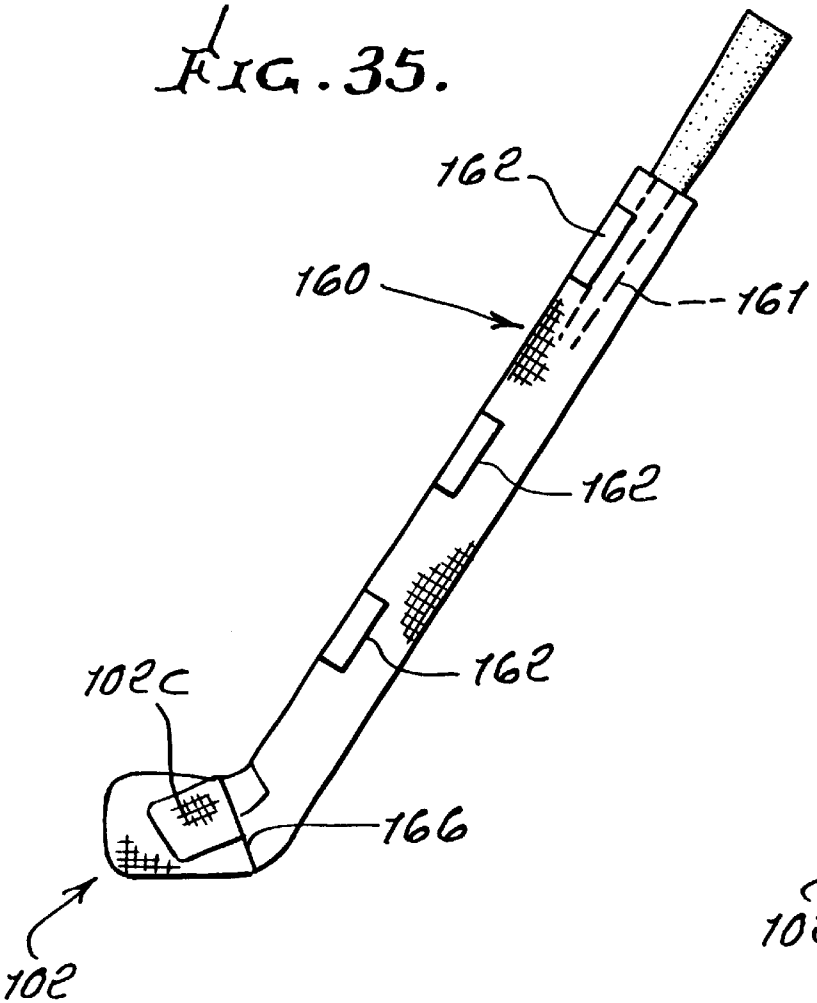

FIG. 18*a* is an elevation showing attachment of a weighting device flap to a golf bag;

FIG. 18*b* is an elevation showing fastener connection of a weighting device to a golf bag;

FIG. 18*c* is a modification;

FIG. 19 is an elevation showing a flap on a weighting device proximate a golf club hosel;

FIG. 20 is a cross section showing sealed weight enclosures for a weighting device;

FIG. 21 is an elevation showing multiple sealed enclosures for weights;

FIG. 22 is a section showing a weight carrier having a moisture proof enclosure for a club head;

FIG. 22*a* show similar expansible weight sock structure;

FIG. 23 is an elevation also showing an expansible sock or receptacle for a club head;

FIG. 24 is an elevation showing a flap on a receptacle that allows fitting to heads of different sizes;

FIG. 25 is a section showing a weight carrying receptacle having a reinforced top opening;

FIG. 26 is a fragmentary section showing reinforcement in the form of binding material;

FIG. 27 shows a receptacle having a rear reinforcement;

FIG. 28 shows a receptacle opened up with two like halves that carry weights;

FIG. 29 is a section showing seamless connection of two like halves of a receptacle;

FIG. 30 is a section showing flap pocket encapsulation of a weight;

FIG. 31 is an elevation showing indicator coloring at one side of a weight receptacle;

FIG. 32 is an elevation showing alternate indicator coloring at the opposite sides of a weight receptacle;

FIG. 33 is an elevation showing wrapping of a weight carrier about a club head;

FIG. 34 is a section showing wrapping of a weight carrier about a club head, and employing VELCRO;

FIG. 35 is an elevation showing a weight carrying sheath that extends onto a club shaft; and FIG. 36 is like FIG. 35, but showing a wrapped sheath.

DETAILED DESCRIPTION

Referring to FIGS. 1–6, a weight holder device is shown at 10, for use on a golf club 100 as during warm-up swinging of the club. The club may for example be an iron or a putter. It includes a receptacle 11 having an opening 12 via which, or through which, a golf club head 13 is received. The receptacle has a front side 11*a*, a rear side 11*b*, a toe end 11*c*, a heel at 11*d*, a top 11*e*, and a bottom 11*f*. In this example, and referring to FIG. 1, the opening 12 extends in the top lie, and in the upper extent of the receptacle, and may have a long dimension indicated at 14. That dimension is typically greater than the maximum height dimension 15 of the head, to allow entry of the head, endwise, through the opening, and into the receptacle, as well as removal from the receptacle. The receptacle typically consists of flexible fabric or material which is tough and durable, as for example synthetic resinous (plastic) material.

The receptacle preferably has wall portions, and typically at least two of the following:

i) a front side or first inner wall portion 16 to extend adjacent, or proximate the face of the golf club head;

ii) a rear side or second inner wall portion 17 to extend adjacent or proximate the club head rear side;

iii) a lower or third wall portion 18 to extend adjacent the elongated bottom surface of the club head;

iv) a forward or fourth wall portion 19 extend forwardly of or adjacent the toe of the club head;

v) a rearward of fifth wall portion 20 to extend adjacent or proximate the heel of the club head;

vi) a top or sixth wall portion 21 to extend adjacent or proximate the top edge of the club head.

The receptacle further defines an interior slot 22 receiving the club head, as for example an iron.

As will be seen, a retainer is carried on the receptacle to be extended and fastened in a position for retaining the receptacle in close fitting relation to the club head.

Figure 1:
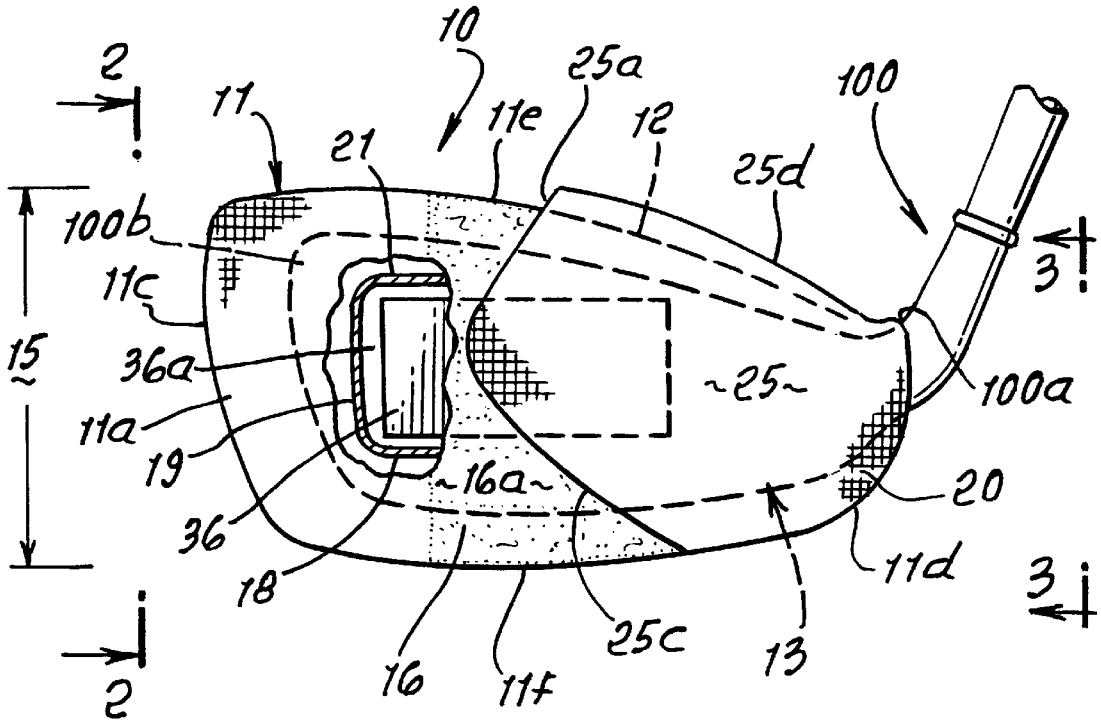
FIG. 1 is a side elevation showing a head receptacle enveloping a golf club head, with a retainer wrapped over a side of the receptacle near the club hosel.
Figure 2:
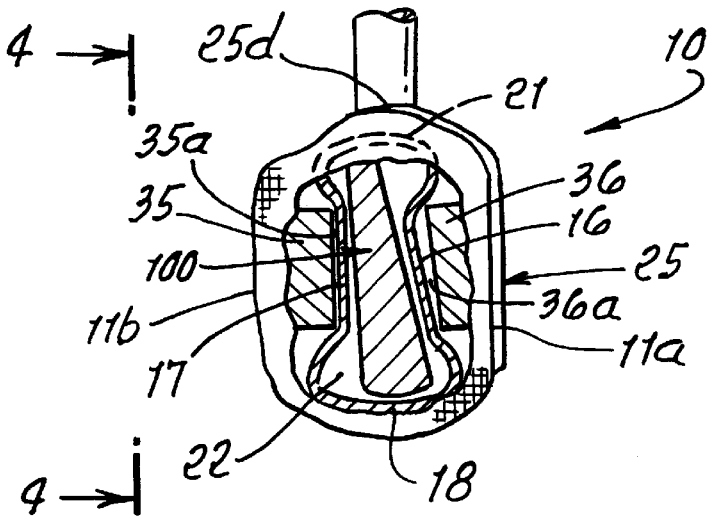
FIG. 2 is a toe end elevation taken on lines 2—2 of FIG. 1.
Figure 5:
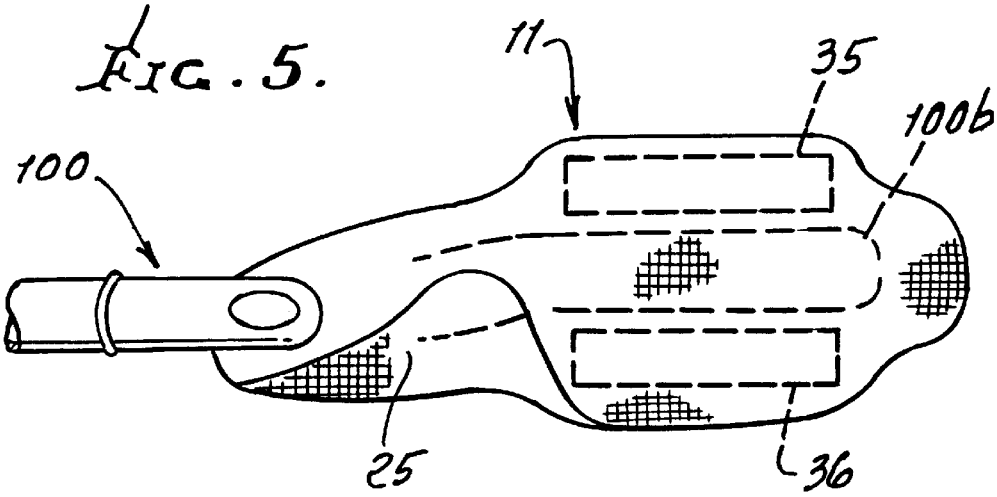
FIG. 5 is a bottom plan view taken on lines 5—5 of FIG. 4.
Figure 6:
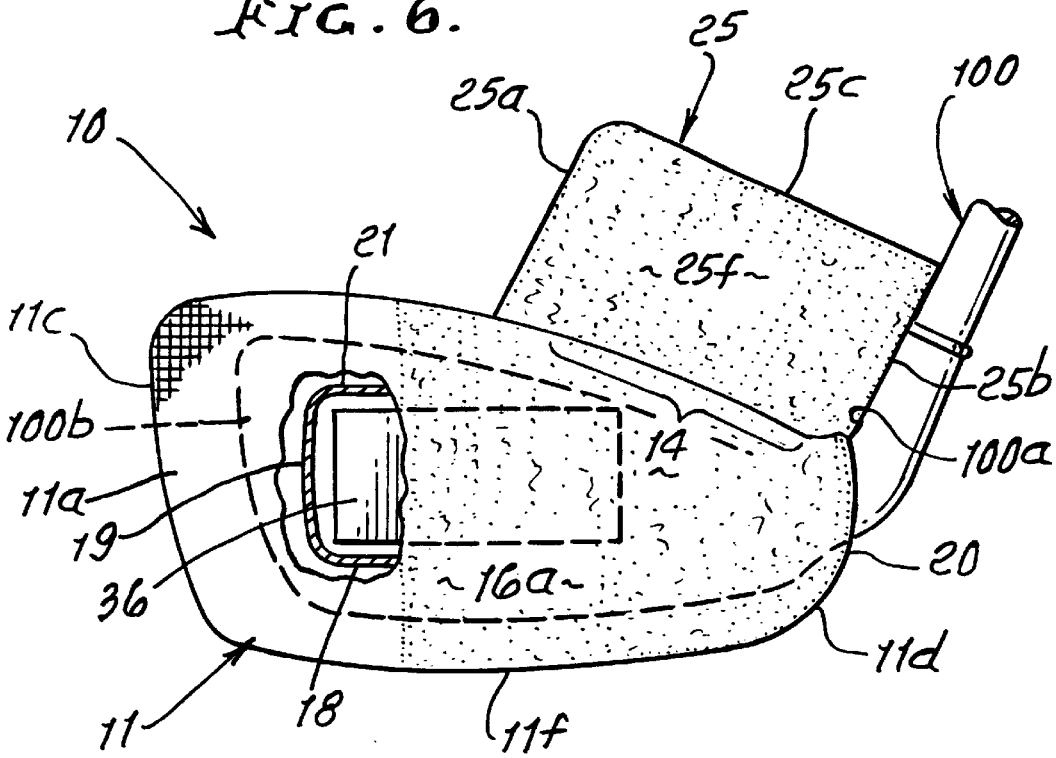
FIG. 6 is a view like FIG. 1, but showing the retainer in unwrapped, open position.

In the example, a retainer in the form of a flap 25 is shown in open, raised position in FIG. 6; and in closed, lowered position in FIG. 1. The flap is or may be integral with the rear side wall portion 17 of the receptacle, and has forward and rearward angled edges 25*a* and 25*b*, and an outer or upper edges (in FIG. 6) 25*c*. When folded downwardly at fold zone 25*d*, rearward edge 25*b*, folds over the hosel upper surface zone 10*a* of a received club head (iron), and then downwardly adjacent the front surface 16*a*, of the receptacle front side 11*a*, as indicated in FIG. 1 and FIG. 2. The flap inner surface 25*f* may be retained to front surface 16*a*, as by hook and pile attachment, enabling easy opening and closing of the flap, and its adjustable closing of the opening at 14, as well as tightening to closely fit the receptacle to the club head, while at the same time providing very firm attachment of the device to a club head, preventing loosening and/or detachment, as during club swinging. The flap fits closely over the top of the head, near the hosel, i.e. at an elevation lower than maximum head height, to retain the receptacle to the head.

Hook and pile structure typically but not necessarily extends over a major extent of the receptacle front side 11*a*, so that the flap can be adjustably attached in selected positions (tightened or loosened), considering the different sizes of different iron heads and hosels to be protectively confined. Therefore, versatility of the device is enhanced. The majority of opening 14 is covered by the flap in FIG. 1.

Further in accordance with the invention, weighting structure carried by the receptacles to add substantive weight to the head weight, for use in said swinging.

The weighting structure is so carried that it is located at or proximate one of the following:

vii) at least one of said wall portion;

viii) at least two of said wall portions ix) at least three of said wall portions x) at least four of said wall portions xi) one or both sides of the head.

In FIGS. 1–6, the weighting structure includes two metallic (steel for example) weights 35 and 36 located in pockets 35*a* and 36*a* at opposite sides of the club head 10*b*. Such pockets may be formed by receptacle material in the inner sides of the front and rear wall portions 16 and 17, to position weight 36 in registration with the club head "sweet spot" (central portion of the club face); and to position weight 35 at the opposite side of the head, in sidewise general registration with weight 36. The thickness of each weight is typically less than its length and less than its width, as shown. The pockets may be closed to hold the weights in positions, as described; however, FIG. 9 shows a modified pocket 40 that is open ended at 40*a*, allowing adjustment of the weight position, in directions 41 and 42. The weight 43 may be suitably retained in an adjusted position as by a holder strap 44 attached to the weight, and selectively attached to receptacle wall fabric, as by hook and pile elements, or other structure. FIG. 13 shows two external pockets 48 and 49 on a side 51 of the receptacle fabric, for selective reception of one or both weights 52 and 52'. Pockets covers 48*a* and 49*a* may be closed, and held in position by hook and pile elements, or snaps 53, as shown.

Weight material may alternatively consist of metallic granules, or pebbles.

FIG. 7 shows alternative positioning of a weight 60 proximate the toe 61 of the receptacle 62, and proximate the toe 63 of the received club head. Weight 60 is carried in a pocket on the receptacle 62. FIG. 8 shows alternative positioning of a weight 65 proximate the upper edge 66 of the receptacle 64, and proximate the upper edge 67 of the received club head 72. A suitable pocket for weight 70 may be provided as in, FIG. 11 showing alternative positioning of a weight 70 proximate the heel 71 of the receptacle, and proximate the heel of a received club head. A suitable pocket for weight 70 may be provided.

FIG. 10 shows downward reception of a club head 80 into a receptacle 81, via an elongated top edge slot at 82, defined by the receptacle. Flap 83 carried by the receptacle folds downwardly over the slot, and attaches to the front side 81*a* of the receptacle, as by hook and pile material, or other attachment. Two weights 84 and 85 are carried by the receptacle, adjacent the hosel of the club head, as in suitable pockets. Weights 84 and 85 may be located at opposite sides of the hosel, and interconnected.

FIG. 12 shows weight holders 90 carried by a bracket 91 that fits over a club head 96. Strap or straps 92 have ends 92*a* attached to one side 91*a* of the bracket, and fold over the open side of the bracket to attach to the opposite side 91*b* of the bracket. Retained weights appear at 95.

Finally, the weights 35 and 36 may be joined together, as by a bend that extends at the exterior of the club head.

Figure 14:
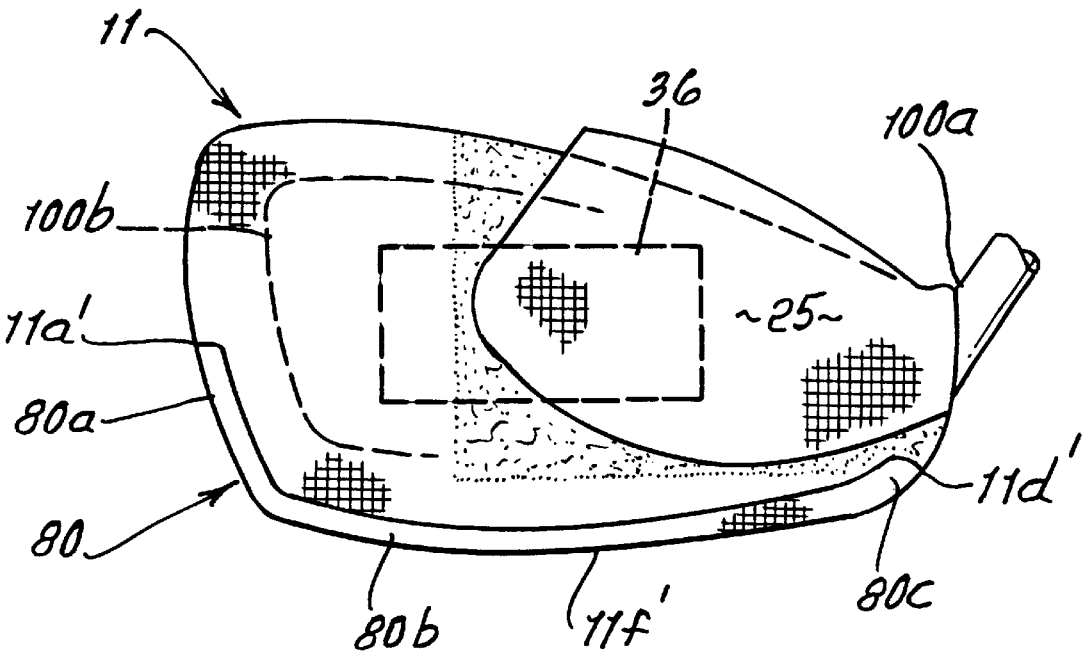

Referring to FIG. 14, it is a view like FIG. 1; however, it shows a scuff protector at a periphery or peripheries of the receptacles to protect said periphery or peripheries against scuffing in the event of contact with a surface as during swinging of the club.

As shown the scuff protector 80 extends at 80*a*, 80*b* and 80*c*, or any of those locations. They are defined as:

$x_1$) lowermost extent of the receptacle, as along its lower edge 11*f'*, $x_2$) at toe portion of the receptacle, as at 11*a'*

$x_3$) a lower heel portion of the receptacle 11*d'*.

The protector is made of scuff resistant material (plastic, metal, or other).

Figure 15:
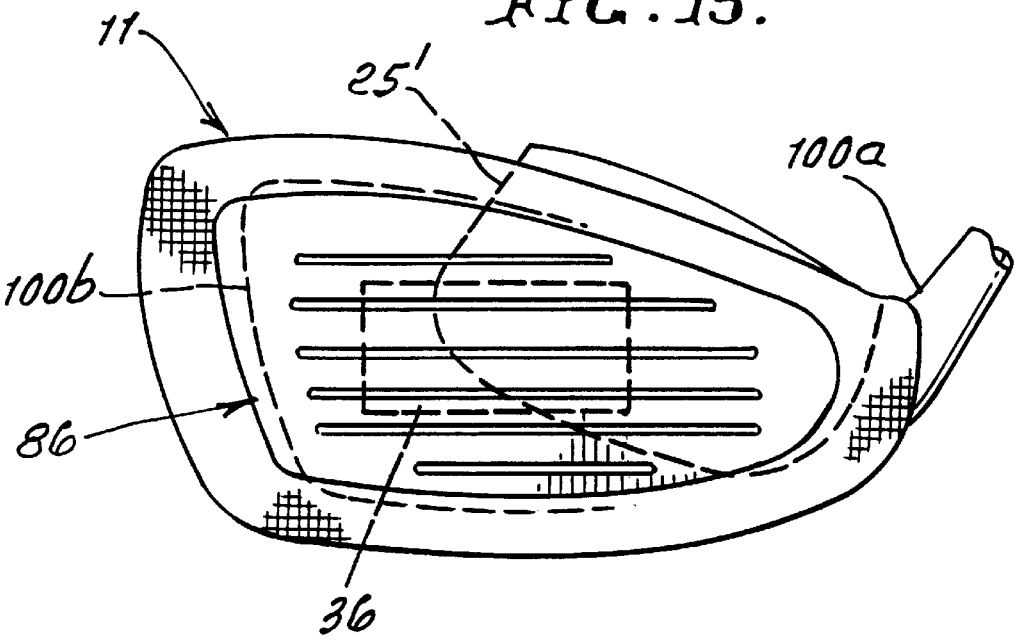

Referring to FIG. 15, it is a view like FIG. 1, however, it shows a striker 86 on the front of the receptacle 11, for striking impact with a ball, during swinging of the club. It may consist of a plate, as for example, consisting of metal, plastic, or other material. The striker is located and attached to the receptacle to register with the front face including the sweet spot, of the golf club head 100*b* received in receptacles. The flap 25' folds over the top of the head, to the rear side thereof, so as not to interfere with the striker.

Figure 16:
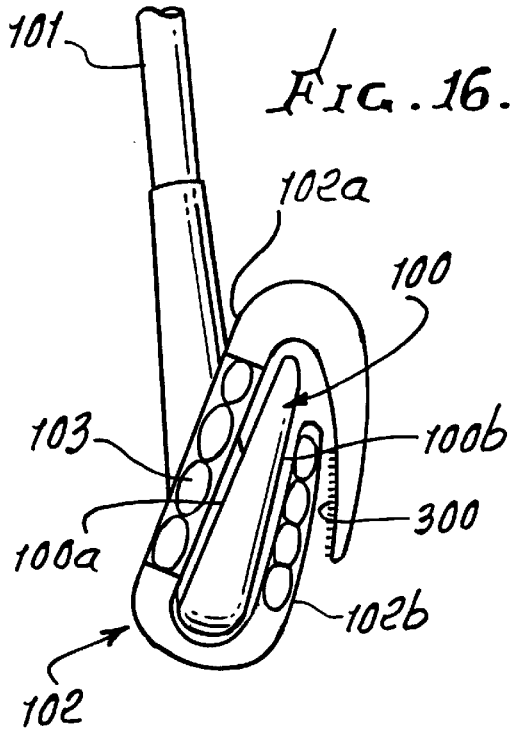
FIG. 16 is a diagram showing elements of a weighting device for use on a golf club.

In a preferred form of the invention, the weighting structure is sized and snugly positioned and retained proximate at least one of the following portions of a club head received in the receptacle;

i) front side portion ii) rear side portion iii) toe portion iv) heel portion v) top portion vi) bottom portion FIG. 16 is an end view of a golf club head 100 and shaft 101, with structure 102 such as a sock as described above, carrying a metallic weight 103 adjacent the head face 100*a*. The sock or wrap 102 may be wrapped at 102*a* and 102*b* about the head, and secured, as by VELCRO 300, at the rear 100*b* of the head.

Figure 17:
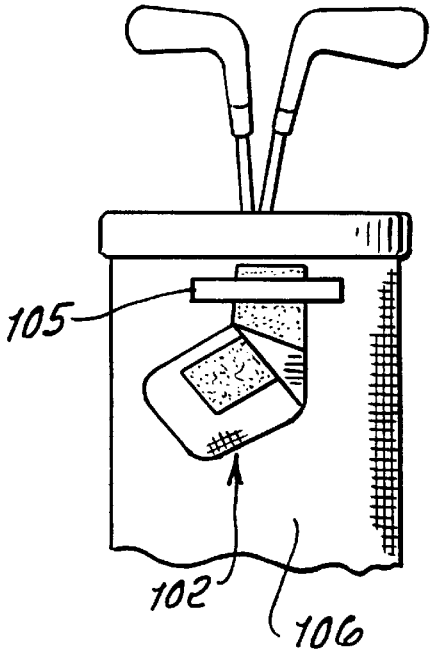
FIG. 17 is an elevation showing a club weighting device connected to a golf bag.

FIG. 17 shows the structure 102, such as a weighted sock of any of the forms described above, attached at 105 to a golf club bag 106, for example by VELCRO. FIG. 18*a* shows the structure 102 attached as by structure flap 102*c* to a loop 107 attached at 108 to golf bag 106. Flap 102*c* fits through the loop and folds down to attach to structure 102.

FIG. 18*b* shows weighted structure 102 having a snap fastener part 111*a* attachable to snap fastener part 111*b* connected to the golf bag 106.

FIG. 18*c* shows weighted structure 102 having a separate flap 113 attachable to a loop 107 on bag 106, as referred to in FIG. 18*a*.

FIG. 19 shows flap 102*c* configured to fold down over head region 100*d*' into fastened (VELCRO) position indicated by broken lines 102*c*', at the side of structure 102. Such folding causes the flap to miss contact with shaft 101, and hosel region 120'.

FIG. 20 is a cross section showing a weight 100*d* in a sealed enclosure 120, such as a plastic sheet, carried by sock structure 102.

FIG. 21 is a side view of multiple sealed enclosures 120*a* for weights 100*d*, carried by sock structure 102 to fit a golf club head. A flap 102*c*. when closed, covers the enclosures 120*a*, and may connect to 102 by VELCRO.

FIG. 22 is a section showing structure 102 carrying weight 103; and a moisture proof enclosure 125 at the inner side of 102 fits around and encompasses the club head 100. This prevents moisture from getting inside the structure 102 or sock and prevents moisture contact with head 100*e*.

FIG. 22*a* shows a structure or sock 102, as in FIG. 18*c*, the sock having an expansible toe portion 102*d*, to fit larger club heads. FIG. 23 is similar.

FIG. 24 shows a sock structure 102, and an elongated flap (see dimension "d") 102*c*" the length of the flap and VELCRO on it allowing the sock to fold to cover sock zone 130, and to fit different size golf clubs.

FIG. 25 shows a sock-like flexible receptacle 102 carrying metallic weights 100*f*, and having reinforcement 131 at the fabric top opening 132. The sock front is shown at 102*e*. The sock fabric 102*f* is more flexible, i.e. weaker. Lower region 301 may be reinforced. FIG. 26 shows a sock having reinforcement such as binding 133 at the fabric top area 102*f*. Weights 100*f* are carried at the side of the sock. FIG. 27 shows a club head receptacle or sock 102 having reinforcement 136 at the heel zone 102*q*.

FIG. 28 shows a fabric receptacle 102 for a club head, and opened up about fold line 140 to form two mirror images halves 102*h* and 102*h*', each carrying multiple weights 100*w*, as shown. See also bottom reinforcement 180.

FIG. 29 is a section shows seamless connection at 140*a* of the two receptacle halves 102*h* and 102*h*'. FIG. 30 is a section showing a weight 100*t* encapsulated in a pocket 151 carried by a receptacle or sock half 102*h*.

FIG. 31 is an elevation showing indicator coloring at X on the inward facing surface of a club head receptacle 102, that carries weights as referred to above. FIG. 32 shows the same receptacle carrying indicator coloring at Y at its outward facing surface.

FIG. 33 is an elevation showing wrapping of a U-shaped weight supporting carrier 202 about a club head, and secured by flap 203, using VELCRO or other fastener material. FIG. 34 is a section showing the carrier 202 and weight 204, before fastening to the club head 205. The club shaft is shown at 205*a*.

FIG. 35 is an elevation showing a flexible fabric sheath 160 fitting the club shaft 161, and carrying weights at 162. The sheath may be attached or attachable at 166 to the sock 102 that also carries a weight or weights as referred to above. FIG. 36 shows a sheath 160*a* that wraps about the shaft, and secures by means of flaps 170 that also wrap about and attach as by VELCRO. Weights may be selectively carried by pockets at the flaps.

I claim:

1. A weighting device for use on a golf club head as during swinging of the club, comprising in combination:

a) a receptacle having an opening via which the club head is received into the receptacle, b) a retainer carried on the receptacle to be fastened in a position for retaining the receptacle in generally fitting relation to the club head, c) and weighting structure carried by the receptacle to add substantial weight to the club head, for use as in club swinging, d) said receptacle having a front portion, a bottom portion, a toe portion, a heel portion, a back portion, and a top portion; and said weighting structure located proximate at least one of said portions, and e) said retainer being foldable to extend at least partly over said opening, and which then extends generally forwardly from proximate said heel portion toward said toe portion, thereby to bring a side of the retainer into position for releasable attachment to a surface carried by the receptacle.

2. The combination of claim 1 including hook and pile fastening material for fastening said retainer in said position.

3. The combination of claim 1 wherein said retainer comprises a flap which when folded and releasably attached to the receptacle extends along a side of the receptacle.

4. The combination of claim 2 wherein said retainer comprises a lap which when folded and releasably attached to the receptacle extends along a side of the receptacle.

5. The combination of claim 1 wherein said retainer at least partly covers a lowermost extent of said opening in said fastened position.

6. The combination of claim 3 wherein said flap extends along a lower rear side of the receptacle in said fastened position.

7. The com bination of claim 1 wherein said receptacle has at least two of the following:

i) a wall portion to extend adjacent the front face of the club head ii) a wall portion to extend adjacent the rear side of the club head iii) a wall portion to extend adjacent the bottom surface of the club head iv) a wall portion to extend adjacent the toe of the club head v) a wall portion to extend adjacent the heel of the club head vi) a wall portion to extend adjacent the top edge of the club head;

and said weighting structure is located at or proximate at least one of said wall portions.

8. The combination of claim 7 wherein said weighting structure is located at or proximate one of the following:

vii) at least one of said wall portions, viii)at least two of said wall portions ix) at least three of said wall portions x) at least four of said wall portions.

9. The combination of claim 1 wherein said weighting structure includes metallic material.

10. The combination of claim 9 wherein said material is concealed by said receptacle.

11. The combination of claim 8 wherein said weighting structure includes separate local metallic portions.

12. The combination of claim 9 wherein said material is held in a pocket or pockets provided by the receptacle.

13. The combination of claim 9 including a club head received in the receptacle, and wherein said material is received in pockets at opposite sides of the club head.

14. The combination of claim 9 wherein said material is received in a pocket provided by the receptacle, the pocket sized to enable adjustment of the position of the material, relative to the pocket.

15. The combination of claim 9 wherein the material is received in a pocket or pockets provided by the receptacle, to enable selective use of the pocket or pockets of the material.

16. The combination of claim 1 including a scuff protector at a periphery or peripheries of the receptacle to protect said periphery or peripheries against scuffing in the event of contact with a surface as during swinging of the club.

17. The combination of claim 16 wherein said scuff protector extends at one of the following:

$x_1$) a lowermost extent of the receptacle $x_2$) a toe portion of the receptacle $x_3$) a lower heel portion of the receptacle.

18. The combination of claim 1 including a striker at a front side of the receptacle, for striking impact with a ball, during swinging of the club.

19. The combination of claim 18 wherein said striker comprises a plate.

20. The combination of claim 1 wherein said weighting structure is sized and snugly positioned and retained proximate at least one of the following portions of a club head received in the receptacle:

i) front side portion ii) rear side portion iii) toe portion iv) heel portion v) top portion vi) bottom portion.

21. A weighting device for use on a golf club as during swinging of a club head, comprising in combination a) a structure defining an associated space for receiving, removably carrying said structure, b) said structure positionable in generally fitting relation to the club head, c) weighting carried by said structure to add substantial weight to the club head, for providing enhanced momentum in the direction of head swinging, and for use as in club swinging, d) and a retainer comprising a flap operatively connected to said structure to extend at least partly on a structure opening in position in which the flap, has forward extent releasably attachable to a surface carried by said structure, the club head receivable into said space via said opening.

22. The combination of claim 21 wherein said structure includes a flap connectible to a golf bag.

23. The combination of claim 22 including one of the following:

a) the flap anchored to said structure to be foldable for attachment to a loop on a golf bag, b) a fastener associated with the flap to attach a fastener part on a golf bag.

24. The combination of claim 21 wherein the flap is folded over a rear portion of a golf club head zone to leave the club hosel exposed.

25. The combination of claim 21 including sealed or sealable enclosure or enclosures for at least one weight carried by said structure.

26. The combination of claim 25 including a multiple of said enclosures in side-by-side sequence, allowing the weight to have a relative close fitting movement when held adjacent a golf club head.

27. The combination of claim 21 wherein said structure includes a receptacle having a moisture-proof wall or walls.

28. The combination of claim 27 wherein said wall or walls substantially enclose a golf club head zone.

29. The combination of claim 21 wherein said structure includes a receptacle having an expansible toe portion to receive and fit golf club head toe portions of different size.

30. The combination of claim 21 wherein said flap has a length to wrap over and conform to golf club heads of different sizes.

31. The combination of claim 21 wherein said structure includes a golf club head receptacle to receive the head, and including reinforcement material on an upper part of said receptacle allowing an unreinforced portion of the receptacle to be flexible and conform to club head curvature.

32. The combination of claim 31 wherein said reinforcement material comprises binding.

33. The combination of claim 21 wherein said receptacle has a reinforced portion below a club hosel.

34. The combination of claim 21 wherein said structure includes two like halves that fold, upwardly at front and rear sides of the club head, said weight carried at an inner side of said flap.

35. The combination of claim 34 wherein said halves are joined at seamless location proximate the bottom of the club head, and are joined with reinforcement proximate the top of the club head.

36. The combination of claim 34 wherein said weighting includes multiple weights encapsulated in pockets at the inner sides of said halves.

37. The combination of claim 21 wherein said structure extends at opposite sides of a club head, and there being a first indicator color on said structure at one side of the head, and a second indicator color on said structure at the opposite side of the head.

38. The combination of claim 21 wherein said structure defines the wrap to wrap closely around a club head, and to be held by a retainer closed about the club head.

39. The combination of claim 38 wherein said retainer comprises hook and pile fastening material.

40. The combination of claim 21 wherein said structure includes a sheath that extends onto the club shaft, and said weighting is carried on said sheath.

41. The combination of claim 40 including a sheath lower portion that encompasses the club head, and a part of said weighting is on said sheath lower portion.

42. A weighting device for use on a golf club of the head as during swinging club head, comprising in combination:

a) the receptacle having an opening via which the club head is received into the receptacle, b) a retainer carried on the receptacle to be fastened in a position for retaining the receptacle to the club head, during said swinging, c) and weighting structure carried by the receptacle to add substantial weight to the club head, for use as in club swinging, d) said receptacle having a front portion, a bottom portion, a toe portion, a heel portion, a back portion, and a top portion; and said weighting structure located proximate at least one of said portions, and e) said retainer being foldable to extend at least partly over said opening, so that a portion of the retainer then extends generally forwardly from proximate said receptacle heel portion toward said toe portion, thereby to bring a size of said portion of the retainer into position for releasable attachment to a surface carried by the receptacle.

43. A weighting device for use on a golf club head as during swinging of the club comprising in combination:

a) a receptacle having an opening via which a club head is received into the receptacle, b) a retainer carried on the receptacle to be fastened in a position for retaining the receptacle to the club head, during said swinging, c) and weighting structure carried by the receptacle to add, substantial weight to the club head, for use as in club swinging, d) said receptacle having a front portion, a bottom portion, a toe portion, a back portion, and a top portion; and said weighting structure located proximate at least one of said portions, and e) said retainer being manipulable to extend at least partly over said opening so that a portion of the retainer then extends generally forwardly toward said toe portion, thereby to bring a side of said portion of the retainer into position for releasably attachment to a surface carried by the receptacle.

* * * * *